United States Patent [19]

Casida

[11] Patent Number: 4,899,821

[45] Date of Patent: Feb. 13, 1990

[54] METHOD AND APPARATUS FOR SERVICING WELL CASING AND THE LIKE

[75] Inventor: Kenneth L. Casida, Bakersfield, Calif.

[73] Assignee: Hydro-Tool Company, Inc., Coalinga, Calif.

[21] Appl. No.: 296,065

[22] Filed: Jan. 12, 1989

[51] Int. Cl.[4] ..... E21B 37/00; E21B 37/08

[52] U.S. Cl. ..... 166/312; 166/222; 166/373

[58] Field of Search ..... 166/222, 223, 312, 202, 166/332, 334, 386, 373

[56] References Cited

U.S. PATENT DOCUMENTS

| | | | |
|---|---|---|---|
| Re. 31,495 | 1/1984 | Zublin | 166/312 |
| 3,797,572 | 3/1974 | Mignotte | 166/127 |
| 3,912,173 | 10/1975 | Robichaux | 166/222 X |
| 4,046,199 | 9/1977 | Tafoya | 166/222 X |
| 4,088,191 | 5/1978 | Hutchison | 166/312 X |
| 4,431,058 | 2/1984 | Spencer et al. | 166/312 |
| 4,671,355 | 6/1987 | Strange | 166/171 |
| 4,673,728 | 8/1988 | Lacey | 166/312 X |
| 4,815,538 | 3/1989 | Burroughs | 166/312 |

*Primary Examiner*—Stephen J. Novosad
*Attorney, Agent, or Firm*—Worrel & Worrel

[57] ABSTRACT

A method and apparatus for servicing well casing and the like using a treating fluid, the apparatus having a first tool; a second tool having a pair of openings; conduit interconnecting the first and second tools in series relation so that a first of the pair of openings communicate through the conduit with the first tool and the second of the pair of openings communicates with the second tool; a source of treating fluid communicating with the second of the pair of openings; and a valve assembly borne by the second tool and engageable with the interior of the well casing and operable by such contact selectively to control the flow of treating fluid through the openings to the first and second tools.

15 Claims, 4 Drawing Sheets

METHOD AND APPARATUS FOR SERVICING WELL CASING AND THE LIKE

BACKGROUND OF THE INVENTION

1. Field of the Invention

The present invention relates to a method and apparatus for servicing well casing and the like and more particularly to such a method and apparatus which are particularly well suited to cleaning, as may be employed in a particular well, the interior surface of the well casing, the well casing perforations, the liner slots, the wire wrap just outside the liner slots and, to some extent, the face of the formation substantially more effectively than has heretofore been possible with conventional methods and apparatus and at substantially less expense and with significantly more reliability. 2 Description of the Prior Art The continued operation of wells of all types requires that the well structure and, to some extent at least, the fluid bearing formation beyond the well structure be cleaned or otherwise treated to insure a substantially unobstructed path for fluid flow from the fluid bearing formation into the interior of the well casing. A variety of devices and methods have in the past been employed for this purpose and they have operated with some success. However, these are notable drawbacks with the operation of such prior art equipment.

When cleaning well casing, it has been found in the past that the application of a treating fluid first through high pressure jets followed by the application of the treating fluid under pressure in the manner of a pressurized wash or bath works best. Thus) tools known in the trade as jet washing tools and opposed cup pressure washing tools are known for use in performing these two separate functions. However, there has in the past been no way to use the tools in conjunction without removing the jet washing tool from the borehole and then attaching and inserting the opposed cup pressure washing tool into the borehole for the performance of its cleaning operation. The need to remove one piece of equipment from the borehole before inserting and using the second piece of equipment is extremely time consuming and, of course, therefore expensive. The additional handling required also increases the possibility of damage to the equipment and injury to personnel. Furthermore, the enormous amount of time required may cause the steps to be performed with less precision than would be desired or in less than the optimum time of application.

There are other problems associated with the use of conventional equipment. It has been known to operate well equipment of a variety of types by rotation of the well tubing on which the equipment is mounted within the well casing. Thus, where a particular piece of equipment during use in the well requires adjustment such as to place it in a different mode of operation, the typical procedure for doing so is to pivot entire string of well tubing on which the equipment is mounted to achieve the result desired in the equipment. Similarly, conventional jet washing tools must be rotated in the casing in order to insure that all of the surfaces of the well casing and the perforations thereof are subjected to the high pressure spray. Since the area to be cleaned is many times the length of the tool, such rotating must be performed a multiplicity of times before the jet washing operation is completed.

Such rotation of the well tubing requires the use of a rotational power source at the earth's surface which is expensive and time consuming to set up and use. Furthermore, since boreholes commonly are deviated from true vertical, sometimes to substantial degrees, throughout their lengths, rotation of the well tubing causes wearing of the tubing and tools and the well casing in the points of contact resulting from such deviation.

Therefore, it has long been appreciated that it would be desirable to have a method and apparatus for servicing well casing and the like which permits the use of a pair of tools in the well casing in sequence without having to remove the well tubing from the borehole between the application of the first tool and the second tool; which permits operation of a tool at depth in a borehole without requiring rotation of the well tubing; which permits the application of jet washing spray to the well casing in a much more effective and efficient manner than has heretofore been possible; which achieves the optimum synergistic effect in the application of jet washing and opposed cup pressure washing; and which substantially reduces the time and expense associated with the servicing of well casing and the like.

SUMMARY OF THE INVENTION

Therefore, it is an object of the present invention to provide an improved method and apparatus for servicing well casing and the like.

Another object of the invention is to provide such a method and apparatus which are capable of independently operating a pair of tools in a borehole without removal of the tools from the borehole after operating the first tool and before operating the second tool.

Another object is to provide such a method and apparatus which can be employed selectively to operate one or more tools at depth in a borehole without rotation of the well tubing upon which the tools are mounted.

Another object is to provide such method and apparatus which are particularly well suited to the sequential operation of a high pressure jet washing tool and an opposed cup pressure washing tool in the cleaning of well casing in a single sequential operation.

Another object is to provide such an apparatus which includes an opposed cup pressure washing tool which is operable with maximum effectiveness and efficiency.

Another object is to provide such an apparatus which includes an opposed cup pressure washing tool having the capability of being moved upwardly or downwardly in a fluid medium in a well casing with little resistance from the fluid medium.

Another object is to provide such an apparatus which includes a high pressure jet washing tool which is operable with maximum effectiveness and efficiency in cleaning well casing and the perforations thereof and without rotation of well tubing on which it is mounted.

Another object is to provide such an apparatus which is remotely operable in a borehole simply by upward or downward movement of the well tubing on which the apparatus is mounted within the borehole.

Other objects and advantages are to provide improved elements and arrangements thereof in an apparatus for the purposes described which is dependable, economical, durable and fully effective in accomplishing its intended purposes.

These and other objects and advantages are achieved, in the preferred embodiment of the present invention, in an apparatus incorporating an opposed cup pressure washing tool and a high pressure jet washing tool linked in series relation and operably interconnected by a valve assembly engageable with the walls of a well casing independently and selectively to direct a treating fluid from the well tubing on which the apparatus is mounted to either of the tools by upward or downward movement of the well tubing, and thereby the apparatus, within the well casing.

DESCRIPTION OF THE PREFERRED EMBODIMENT

Figure 1:
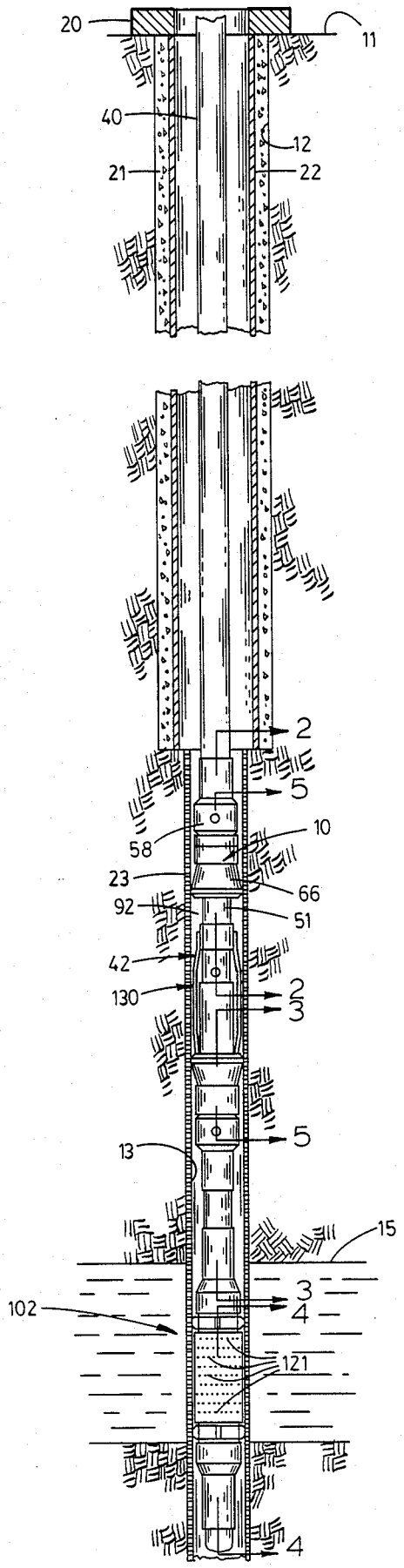
FIG. 1 is a fragmentary, longitudinal vertical section of a borehole and well casing showing the apparatus for servicing well casing and the like in a typical operative environment.

Referring more particularly to the drawings, the apparatus for servicing well casing and the like of the present invention is generally indicated by the numeral 10 in FIG. 1. The apparatus is shown in FIG. 1 in a typical operative environment wherein the earth's surface is represented at 11, an upper borehole at 12 and a lower borehole at 13. For illustrative convenience an oil bearing formation is indicated at 15. As will hereinafter become more clearly apparent, the method and apparatus of the present invention have application to a wide variety of work environments including, but not limited to, oil wells, water wells, gas wells and the like. The environment shown herein, that being an oil well, is merely representative of one such work environment.

A concrete well head 20 is mounted on the earth's surface 11. The upper borehole 12 is bounded by a concrete wall 21 and upper well casing 22. A lower well casing 23 is mounted in the lower borehole 13. The lower well casing has a side wall 24 having an interior surface 25. The side wall has a multiplicity of perforations 26 extending therethrough to form a path for the flow of oil form the oil bearing formation 15 into the interior of the lower well casing.

Figure 2:
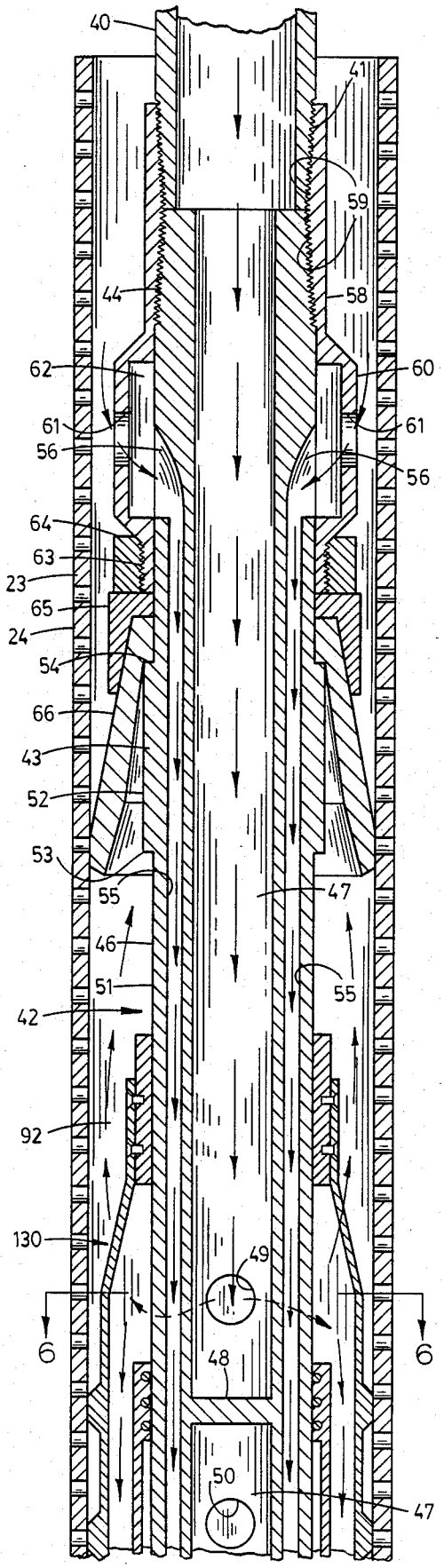
FIG. 2 is a somewhat enlarged, fragmentary longitudinal vertical section taken from a position indicated by line 2—2 in FIG. 1 and showing the upper portion of the opposed cup pressure washing tool of the apparatus of the present invention.
Figure 6:
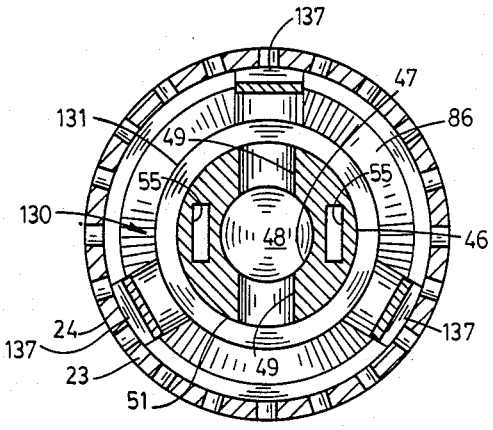
FIG. 6 is a transverse horizontal section taken from a position indicated by line 6—6 in FIG. 2.

The apparatus 10 is mounted, in the illustrative embodiment, on well tubing 40 having an externally screw threaded, or male, end portion 41. The apparatus includes an opposed cup pressure washing tool 42 which is mounted on the end portion 41 of the well tubing. The washing tool has a conduit, main body, or washing tool mandrel 43 which is substantially cylindrical and has an upper externally screw threaded end portion 44 and an opposite, lower externally screw threaded end portion 45. The mandrel has a substantially cylindrical side wall 46 bounding a main fluid passage 47 extending the full length thereof and open through the end portions 44 and 45. Thus, the main fluid passage communicates with the interior of the well tubing 40. The main passage is obstructed in fluid sealing relation by a flow passage plug or wall 48 extending thereacross, as best shown in FIG. 2. A washing tool port, or second opening, 49 extends through the side wall 46 of the mandrel adjacent to and above the wall 48 to interconnect the main fluid passage and the exterior of the side wall 46. A jet washing tool port, or first opening, 50 extends through the side wall 46 to interconnect the main fluid passage and the exterior of the side wall 46.

The mandrel 43 has a cylindrical external surface 51 bounded at an upper end by a stop ring 52 which is integral with the mandrel. The stop ring has a slide valve stop 53 and an opposite wash cup stop 54.

A pair of bypass passages 55 extend through the side wall 46 longitudinally of the mandrel 43 and on opposite sides of and parallel to the main fluid passage 47 from upper entrances 56 adjacent to and on opposite sides of the upper end portion 44 to lower entrances 57 adjacent to and on opposite sides of the lower end portion 45.

As shown best in FIG. 2, a thimble lock nut carrier or mounting member 58 has an internally screw threaded end portion 59 which is screw-threadably, mounted on the upper end portion 44 of the mandrel 43 and on the end portion 41 of the well tubing 40. The mounting member has a housing 60 having four openings 61 which communicate with an internal chamber 62 which extends entirely about the mandrel. When mounted in position as described and shown in the drawings, the openings 61 provide a path of fluid entry to the upper entrances 56 of the bypass passages 55. The chamber insures such communication even though when assembled the openings 61 may not align with the upper entrances 56.

The mounting number 58 has an externally screw threaded end portion 63 which mounts a thimble lock nut 64. A wash cup retaining thimble 65 and a resilient wash cup 66 are captured between the thimble lock nut 64 and end of the mounting number 58 and the wash cup stop 54 of the stop ring 52. The wash cup faces downwardly and has an outer diameter dimensioned to engage the interior surface 25 of the side wall 24 of the lower well casing 23.

Figure 3:
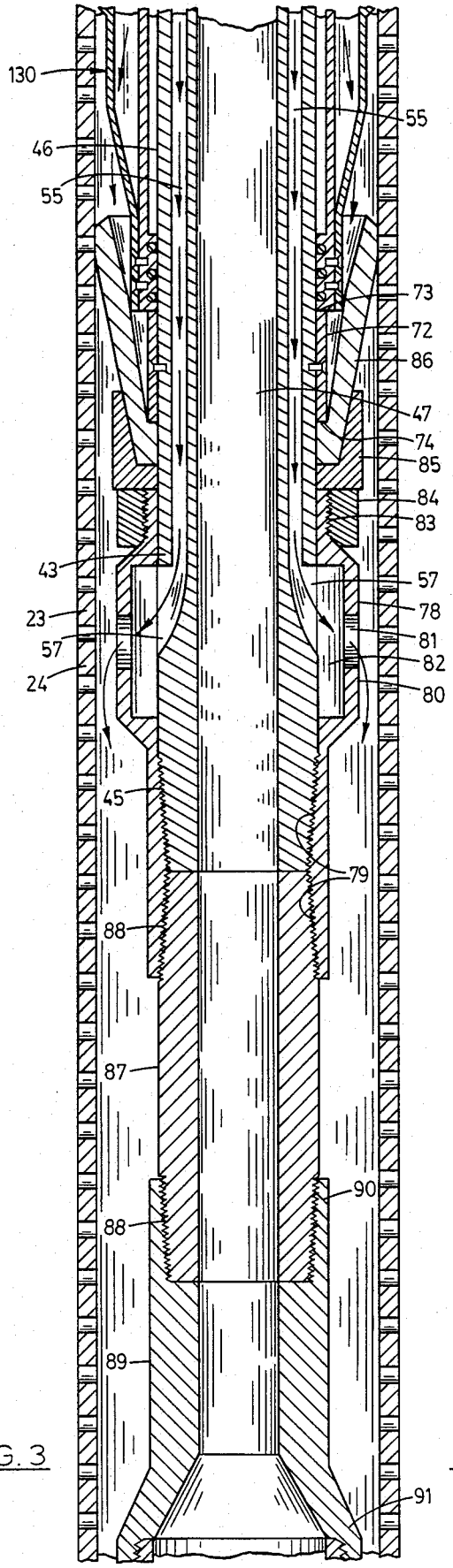
FIG. 3 is a somewhat enlarged, fragmentary longitudinal vertical section taken from a position indicated by line 3—3 in FIG. 1 and showing the lower portion of the opposed cup pressure washing tool shown of FIG. 2.
Figure 5:
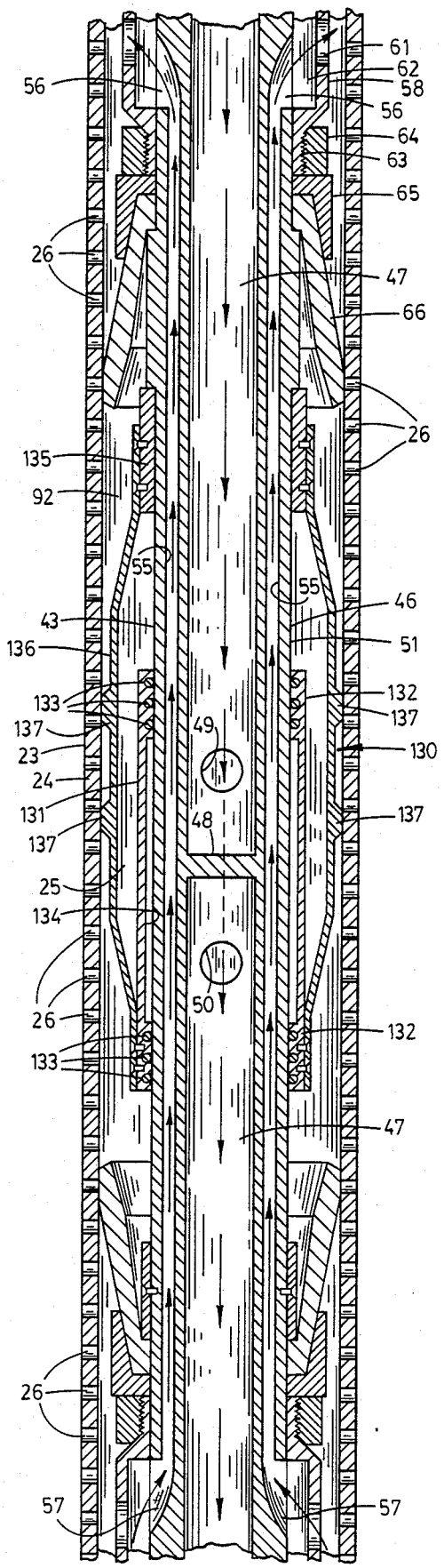
FIG. 5 is a somewhat enlarged, fragmentary longitudinal vertical from a position indicated by line 5—5 in FIG. 1.

As best shown in FIGS. 3 and 5, the opposite end portion of the opposed cup pressure washing tool 42 has a structure closely similar to that heretofore described with respect to the upper end portion. A removable stop ring 72 is mounted on the external surface 51 of the mandrel 43 by suitable bolts or the like. The stop ring is removable for purposes of assembly and disassembly of the pressure washing tool 42. The stop ring 72 has a slide valve stop 73 and an opposite wash cup stop 74.

A thimble lock nut carrier or mounting member 78 has an internally screw threaded end portion 79 which is screw-threadably secured on the lower end portion 45 of the mandrel. The mounting member 78 has a housing 80 with four openings 81 therein communicating with a chamber 82 which extends entirely about the mandrel. When mounted in position as described, the openings provide a path of fluid entry to the lower entrances 57 of the bypass passages 55. The chamber insures such communication even though when assembled the openings 81 may not align with the lower entrances 57.

The mounting member 78 has an externally screw threaded end portion 83 which mounts a thimble lock nut 84. A wash cup retaining thimble 85 and a resilient wash cup 86 are captured between the thimble lock nut 84 and end of the mounting member 78 and the wash cup stop 74 of the removable stop ring 72. The wash cup 86 faces upwardly and has an outer diameter dimensioned to engage the interior surface 25 of the side wall 24 of the lower well casing 23.

As shown in FIG. 3, a cross over nipple or connection coupling 87, having opposite externally screw threaded end portions 88, is screw-threadably mounted in the internally screw threaded end portion 79 of the mounting member 78. A jet tool body adapter 89, having an internally screw threaded end portion 90 and an opposite enlarged internally screw threaded end portion 91, is screw-threadably mounted on the end portion 88 of the connection coupling 87. Referring to FIG. 5, the area bounded by the wash cups 66 and 86, the mandrel 43 and the interior surface 25 of the side wall 24 of the lower well casing 23 constitute an external wash or pressure chamber 92.

Figure 4:
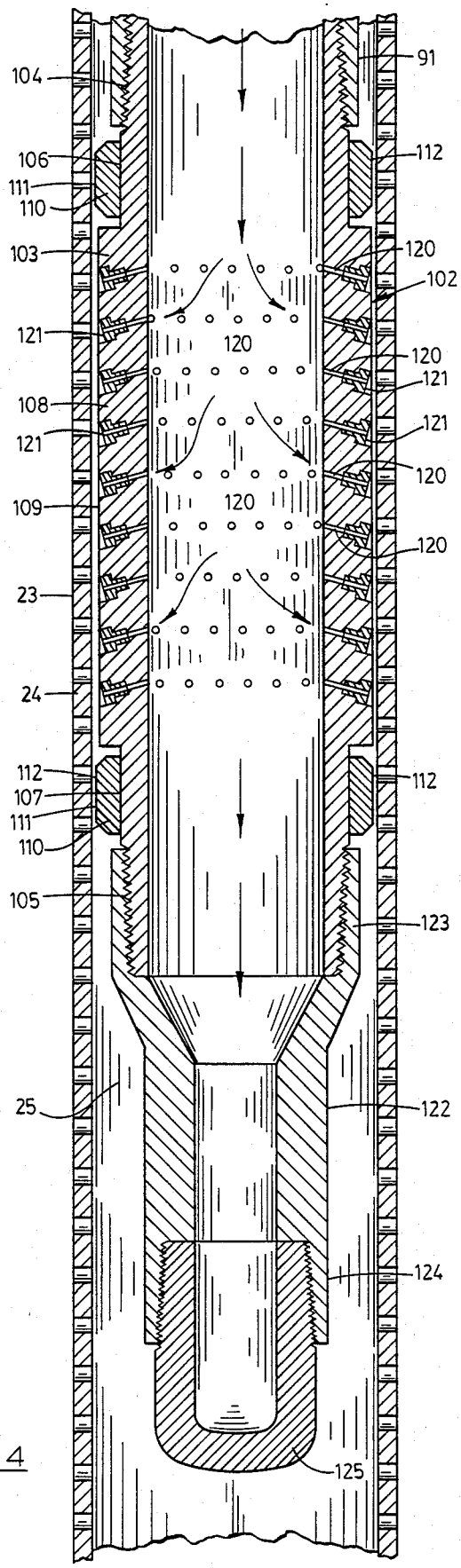
FIG. 4 is a somewhat enlarged, fragmentary longitudinal vertical section taken from a position indicated by line 4—4 in FIG. 1 and showing the high pressure jet washing tool of the apparatus of the present invention.

The apparatus 10 has a high pressure jet washing tool 102 shown best in FIG. 4. The jet washing tool has a jet tool body 103 with an upper externally screw threaded end portion 104 and an opposite lower externally screw threaded end portion 105. The upper end portion 104 is screw-threadably mounted in the enlarged end portion 91 of the jet tool body adapter 89. The jet tool body has an upper end portion 104 and a lower shank portion 107 just inwardly of the lower end portion 105. The jet tool body has a cylindrical central section 108 having an outer surface 109 of a predetermined diameter preferably spaced approximately four tenths (0.04) of an inch from the interior surface 25 of the side wall 24 of the lower casing 23. A pair of jet tool centralizers 110 are individually mounted on the upper and lower shank portions 106 and 107 respectively. Each centralizer is a ring having projections 111 extending to terminal ends 112 defining a diameter greater than the diameter of the outer surface 109 so that approximately the desired spacing is maintained between the outer surface 109 of the central section and the interior surface 25.

The central section 108 of the jet tool body 103 has a multiplicity of downwardly angled bores 120 interconnecting the interior of the central section and the outer surface 109 thereof. Each of the bores has a spray nozzle 121 therein. The nozzles are preferably, although not necessarily, individually disposed at angles of 15 degrees downwardly from a line of reference at right angles to the longitudinal axis of the jet tool body in an outwardly facing direction, as best shown in FIG. 4. Each of the spray nozzles preferably, although not necessarily, has a four hundredths (0.040) of an inch diameter jet orifice. The nozzles are preferably, although not necessarily, arranged in rows extending about the tool body. There are preferably, although not necessarily, sixty (60) such nozzles in each row disposed in six (6) degree phased spacing about the entire periphery of the outer surface 109 within their respective row. Thus, as shown in FIG. 4, the nozzles are disposed in nine rows with each row defining a plane normal to the longitudinal axis of the jet tool body and corresponding nozzles in adjacent rows are off set relative to each other. In such an array of nozzles, it has been found that the entire interior surface 25 and the perforations 26 thereof can thoroughly be cleaned without rotating the jet washing tool 102. This has significant advantages hereinafter to be described.

A jet tool body adapter 122, having an enlarged internally screw threaded end portion 123 and an opposite internally screw threaded end portion 124, is mounted on the lower externally screw threaded end portion 105.

The apparatus 10 mounts a slide valve assembly 130 on the cylindrical external surface 51 of the pressure washing tool 42, as best shown in FIG. 5. The slide valve assembly includes a slide valve 131, having opposite end portions 132 each having an internal slide valve seal packing 133 engaging the external surface 51 of the washing tool mandrel 43. The slide valve seal packing at both ends of the slide valve bound an internal valve chamber 134 which extends entirely around the mandrel and is of sufficient length to overlap and thus interconnect in fluid transferring relation the second opening 49 and the first opening 50 as can best be seen in FIG. 5. The slide valve is slidable along the mandrel while maintaining the chamber in a fluid tight condition.

The slide valve assembly 130 has an upper guide ring 135 which extends about the cylindrical external surface 51 of the mandrel 43 and is also slidable therealong. Four slide valve low springs 136 are mounted on and interconnect the slide valve 131 and the upper guide ring 135. The low springs have contact projections 137 which contact the interior surface 25 of the side wall 24. The low springs provide sufficient outward pressure to maintain sufficient frictional contact for operation of the slide valve assembly. The slide valve assembly is slideable between an upper position shown in FIG. 5 with the upper guide ring 135 abutting the slide valve stop 53 of the stop ring 52 and a lower position shown fragmentarily in FIG. 3 with the slide valve 131 abutting the removable stop ring 72. In the upper position, the slide valve interconnects the openings 49 and 50. In the lower position, the slide valve covers only the opening 50 and leaves opening 49 exposed.

OPERATION

The operation of the described embodiment of the subject invention is believed to be clearly apparent and is briefly summarized at this point.

When cleaning of the lower well casing 23 is required, the well tubing 40 is withdrawn from the upper and lower boreholes 12 and 13 and the apparatus 10 mounted in position thereon as heretofore described. The apparatus is then lowered into the borehole on the well tubing by convention means to, for example, the position shown in FIG. 1. Contact of the projections 137 with the interior surface 25 of the side wall 25 of the lower casing 23 causes the slide valve assembly 130 to be moved to the upper position shown in FIG. 5 to interconnect the second opening 49 and the first opening 50 through the valve chamber 134.

Such positioning of the slide valve assembly 130 operates to isolate the pressure chamber 92 of the pressure washing tool 42 from the flow of fluid. The pressure washing tool is thus rendered inoperable. With the slide valve assembly 130 in the upper position, the path of fluid flow from the well tubing 40 into the apparatus 10 is downwardly through the main fluid passage 47, outwardly through the second opening 49 into the valve chamber 134, into the first opening 50, downwardly through the main fluid passage 47 below the wall 48, through the connection coupling 87 and into the interior of the jet washing tool 102.

The jet washing tool 102 is positioned in the lower well casing 23 opposite the interior surface 25 and perforations to be cleaned, as can best be visualized in FIG.

4. Normally, the jet washing tool will be employed first on the surfaces at the bottom of the oil bearing formation 15 as can best be visualized in FIG. 1. However, these decisions are obviously within the discretion of the operators.

The well tubing 40 and apparatus 10 is then pressurized with a suitable treating fluid to activate the jet washing tool 102. A variety of treating fluids can be employed, but typically a compatible water such as formation water or fresh water is employed. In some instances a solvent or acid is added to the fluid. The amount of pressure to be applied is also within the discretion of the operators. However, the application of pressure in the range of from 2300 to 2400 pounds per square inch is typical in the preferred embodiment. Pressurization of the interior of the jet washing tool causes the spray nozzles 121 to release the treating fluid in a high pressure spray at oblique angles to the interior surface 25. It has been found that the high pressure application of spray at an oblique angle to the interior surface produces a more effective cleaning operation. It appears to cause the spray to strip away the material borne by the interior surface and within the perforations 26. The multiplicity of spray nozzles allows optimum cleaning without pivoting or rotation of the well tubing and jet washing tool. This saves the expense and consumption of time involved in setting up and using a rotational power source on the earth's surface.

When high pressure jet washing of a particular section of the lower well casing 23 has been completed, the apparatus 10 is lowered further down the lower well casing 23 until the pressure washing tool 42 of the apparatus is below the area where jet washing has just been performed. The apparatus is then drawn back upwardly in the lower well casing 23 until the wash cups 66 and 86 are aligned with and bound the area of the lower well casing where the jet washing has already been performed. The upward movement of the apparatus in the lower well casing moves the slide valve assembly to the position shown in FIG. 2 thus exposing the second opening 49. The we]1 tubing 40 is then again pressurized with the treating fluid to pressurize the pressure chamber 92 of the pressure washing tool 42. Depending upon the condition of the lower well casing and perforations, such initial pressurization is typically to within a range of from 500 to 2000 pounds per square inch. However, as the pressure of the treating fluid breaks down the material plugging the perforations and the material plugging the face of the formation and beyond, flow from the pressure chamber 92 increases and the pressure typically drops below 500 pounds per square inch.

The above described process is repeated in sequence until all of the area desired to be cleaned has been cleaned. It has been found that there is a synergistic effect in that jet washing cleans the interior surface 25 to provide a better seal by the wash cups in the pressure washing stage, the jet washing opens 75 to 100 percent of the available perforated area and the initial cup washing pressure provides an immediate indication of the effectiveness of the jet washing stage. The application of the treating fluid using the pressure washing tool thereafter operates substantially more effectively to clean the well casing and the structure and formation therebeyond.

The bypass passages 55 permit the apparatus 10 to be positioned at any desired location in the borehole without fluid within the borehole preventing or resisting such positioning. The fluid in the borehole, or more precisely the upper or lower well casing simply passes upwardly or downwardly through the bypass passages and thereby out of the way of the apparatus. When the cleaning operation is complete, the apparatus is withdrawn from the borehole by the well tubing 40.

Therefore, the method and apparatus for servicing well casing and the like permit the use of a pair of tools in the well casing in sequence without having to remove the well tubing from the borehole between the application of the first tool and the second tool; permit operation of a tool at depth in a borehole without requiring rotation of the well tubing on which it is mounted; permit the application of jet washing spray to the well casing in a much more effective and efficient manner than has heretofore been possible; achieves the optimum synergistic effect in the application of jet washing and opposed cup pressure washing; and substantial reduce the time and expense associated with the servicing of well casing and the like.

Although the invention has been herein shown and described in what is conceived to be the most practical and preferred method and apparatus, it is recognized that departures may be made therefrom within the scope of the invention, which is not to be limited to the illustrative details disclosed.

Having described our invention, what we claim as new and desire to secure by Letters Patent is:

1. An apparatus for servicing well casing and the like comprising a pair of tools; .means interconnecting the tools of said pair in series relation and having a pair of openings, a first of which communicates with a first of the tools of said pair of tools and a second of which communicates with a second of the tools of said pair of tools; a source of fluid communicating with the second of said pair of openings; and a valve assembly borne by said interconnecting means and engageable with the interior of the well casing operable by said contact in movement down said well casing to place said pair of openings in fluid communication with each other to supply said fluid to said first tool and operable by said contact with the interior of the well casing in movement up said well casing substantially to seal said first opening to supply said fluid to said second tool through said second opening.

2. The apparatus of claim 1 wherein said second tool has a passage running therethrough to allow fluid within the well casing and outside of the pair of tools to bypass said pair of tools within the well casing.

3. The apparatus of claim 1 wherein the first tool has an interior communicating with said first opening for the receipt of fluid from said source and a plurality of jets for the release of said fluid under pressure from said interior outwardly against the well casing for cleaning thereof.

4. The apparatus of claim 1 wherein said interconnecting means includes a conduit interconnecting the first and second tools of said pair of tools and communicating with said source of fluid, the conduit has a main passage extending through the second tool and communicating with the interior of the first tool, the second tool and communicating with the interior of the first tool, the second tool has an external chamber for application of the fluid to the well casing, said first and second openings individually interconnect the main passage of the conduit and said external chamber of the second tool and a wall is mounted in sealing relation in the main passage of the well tubing between the first and second openings to provide a path of fluid movement from the main passage, through the second opening into the external chamber of the second tool and back into the main passage through the first opening as controlled by said valve assembly.

5. The apparatus of claim 4 including a discrete bypass passage extending through the second tool interconnecting the exterior of the conduit on opposite sides of and isolated from communication with the external chamber of the second tool providing a path of fluid movement in the well casing from one side of the second tool to the other.

6. The apparatus of claim 5 wherein said bypass passage extends through the second tool along a course which does not intersect said first and second openings.

7. An apparatus for servicing well casing and the like by the application of a treating fluid and adapted to be mounted on well tubing position internally of the well casing and connected to a source of said treating fluid, the apparatus comprising:

A. A first tool having a side wall enclosing an internal chamber and a plurality of nozzles mounted on the side wall interconnecting the interior chamber and the exterior of the tool in fluid discharging relation;

B. a second tool having a side wall enclosing a main internal passage and having an external surface, a sealing wall mounted in and sealing said main internal passage, a first opening extending through said side wall on one side of the sealing wall interconnecting the main internal passage and the exterior of the second tool, a second opening extending through said side wall on the opposite side of the sealing wall from the first opening interconnecting the main internal passage and the exterior of the second tool and resilient cups dimensioned for sealing engagement with the well casing mounted on the side wall in spaced relation to each other on opposite sides of said first and second openings to define an external wash chamber;

C. a valve assembly mounted on the side wall of the second tool within said external wash chamber, said valve assembly including a slide valve mounted on the external surface of the side wall of the second tool for slidable movement between a first position covering the first and second openings and a second position covering only the first opening, a fluid passage extending in fluid transferring relation therethrough operable when the slide valve is in the first position to interconnect the first and second passages of the second tool in fluid transferring relation and means borne by the slide valve for frictionally engaging the well casing;

D. connecting tubing interconnecting the second tool with said well tubing and the first tool in series relation with the second tool, whereby when the apparatus is moved downwardly in the well casing said engaging means positions the slide valve in said first position and when the apparatus is moved upwardly in the well casing said engaging means positions the slide valve in said second position; and E. means for selectively positioning said well tubing, and thereby the apparatus borne thereby, in the well casing and for delivering said treating fluid under pressure through the well tubing, and thereby to the apparatus.

8. The apparatus of claim 7 wherein a bypass passage extends longitudinally through the side wall of the second tool substantially parallel to and isolated from said main internal passage thereof and communicates with the exterior of the side wall of the second tool on opposite sides of said cups thereby being isolated from the external wash chamber of the second tool so that fluid in the well casing outwardly of the second tool can bypass the cups and the external wash chamber thereof so as not to resist positioning of the apparatus in the well casing.

9. The apparatus of claim 7 wherein said nozzles of the first tool are mounted on the side wall thereof at oblique angles so that treating fluid is discharged therefrom during operation at an oblique angle to the well casing.

10. The apparatus of claim 7 wherein the first tool has a longitudinal axis and said oblique angle of the nozzles is substantially about 15 degrees downwardly in the direction of the exterior of the side wall from a line of reference normal to said longitudinal axis.

11. The apparatus of claim 7 wherein the first tool has a substantially cylindrical external surface and the first tool mounts laterally extending spacing members having terminal surfaces defining a greater diameter than that of said substantially cylindrical external surface and substantially concentric thereto for positioning the nozzles mounted on the side wall in spaced juxtaposition to the well casing.

12. The apparatus of claim 7 wherein the first tool is a high pressure jet washing tool and the second tool is an opposed cup pressure washing tool which are selectively operated by moving the well tubing downwardly in the well casing to move the slide valve to said first position to operate the first tool and, alternatively, by moving the well tubing upwardly in the well casing to move the slide valve to said second position to operate the second tool.

13. A method for servicing well casing and the like, having an internal surface, comprising the steps of:

A. inserting an apparatus in the well casing to a work area within the well casing;

B. applying a treating fluid to the internal surface of the well casing in said work area in high pressure jets of said treating fluid;

C. terminating said application of treating fluid in high pressure jets; and

D. without removing said apparatus from the well casing, pressurizing an area contiguous with said work area with said treating fluid to a pressure greater than the ambient pressure of any fluid in said work area.

14. The method of claim 13 wherein said treating fluid is applied in step B in jets of said treating fluid at oblique angles to said internal surface of the well casing.

15. The method of claim 13 including:

E. repeating steps B, C and D in a second work area on the internal surface of the well casing without removing said apparatus from the well casing.

* * * * *

UNITED STATES PATENT AND TRADEMARK OFFICE

CERTIFICATE OF CORRECTION

PATENT NO. : 4,899,821

DATED : February 13, 1990

INVENTOR(S) : Kenneth L. Casida

It is certified that error appears in the above-identified patent and that said Letters Patent is hereby corrected as shown below:

Column 1, Line 18

Delete "2 De-" Start new paragraph on Line 19 inserting ---2. De--- before scription Column 1, Line 34

Delete ")" and Insert ---,---

Column 1, Line 66

Delete "rotating" and Insert ---rotation---

Column 3, Line 29

Insert ---section taken--- after vertical

Column 6, Line 47

Delete "convention" and Insert ---conventional---

Column 7, Line 41

Delete "we]l" and Insert ---well---

UNITED STATES PATENT AND TRADEMARK OFFICE

CERTIFICATE OF CORRECTION

PATENT NO. : 4,899,821

DATED : February 13, 1990

INVENTOR(S) : Kenneth L. Casida

It is certified that error appears in the above-identified patent and that said Letters Patent is hereby corrected as shown below:

Column 8, line 30, delete "." before means

Signed and Sealed this

Twelfth Day of February, 1991

*Attest:*

HARRY F. MANBECK, JR.

*Attesting Officer*

*Commissioner of Patents and Trademarks*